US011631955B2

(12) United States Patent
Kitagawa

(10) Patent No.: US 11,631,955 B2
(45) Date of Patent: Apr. 18, 2023

(54) CONNECTOR ASSEMBLY AND ELECTRONIC APPARATUS INCLUDING CONNECTOR ASSEMBLY

(71) Applicant: HIROSE ELECTRIC CO., LTD., Kanagawa (JP)

(72) Inventor: Ryohei Kitagawa, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 12 days.

(21) Appl. No.: 17/337,896

(22) Filed: Jun. 3, 2021

(65) Prior Publication Data

US 2021/0391676 A1 Dec. 16, 2021

(30) Foreign Application Priority Data

Jun. 16, 2020 (JP) ..... JP2020-103736

(51) Int. Cl.
*H01R 24/60* (2011.01)
*H01R 13/52* (2006.01)

(52) U.S. Cl.
CPC ..... *H01R 24/60* (2013.01); *H01R 13/52* (2013.01)

(58) Field of Classification Search
None
See application file for complete search history.

(56) References Cited

U.S. PATENT DOCUMENTS 6,106,306 A * 8/2000 Koga ..... H01R 12/716 439/74
6,793,506 B1 * 9/2004 Hirata ..... H01R 12/716 439/74
7,264,484 B2 * 9/2007 Takano ..... H01R 43/26 439/74
8,961,215 B2 * 2/2015 Hasegawa ..... H01R 12/00 439/74
11,050,174 B2 * 6/2021 Midorikawa ..... H01R 13/502
2002/0137396 A1 * 9/2002 Ono ..... H01R 13/6456 439/680
2003/0181098 A1 * 9/2003 Kropp ..... H01R 12/716 439/577
2004/0029410 A1 * 2/2004 Akama ..... H01R 12/716 439/65

(Continued)

FOREIGN PATENT DOCUMENTS

JP 2016-157529 A 9/2016

*Primary Examiner* — Oscar C Jimenez
(74) *Attorney, Agent, or Firm* — Rankin, Hill & Clark LLP

(57) ABSTRACT

Provided is a connector assembly including a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, and each of the first and second connectors is an integrally-molded product including an insulating member and a conductive member.

16 Claims, 11 Drawing Sheets

(56) References Cited

U.S. PATENT DOCUMENTS

| | | | | |
|---|---|---|---|---|
| 2004/0029415 | A1* | 2/2004 | Chih | H01R 12/716 439/74 |
| 2006/0264075 | A1* | 11/2006 | Obikane | H01R 24/60 439/74 |
| 2008/0207010 | A1* | 8/2008 | Ono | H01R 13/639 439/55 |

* cited by examiner

CONNECTOR ASSEMBLY AND ELECTRONIC APPARATUS INCLUDING CONNECTOR ASSEMBLY

CROSS-REFERENCE TO RELATED APPLICATION

This application claims priority from Japanese Patent Application No. 2020-103736 filed with the Japan Patent Office on Jun. 16, 2020, the entire content of which is hereby incorporated by reference.

BACKGROUND

1. Technical Field

The present disclosure relates to a connector assembly and an electronic apparatus including the connector assembly.

2. Related Art

In a connector assembly including two connectors (a receptacle and a plug), a technology of adding the function of preventing the entry of a liquid substance into the receptacle and the plug is known. For example, JP-A-2016-157529 discloses a connector assembly including a first connector 2 and a second connector 3. A press-fit groove 13 and contacts 20 are placed in the first connector 2. In addition, a sheet-shaped waterproof material 35 is bonded fast to the first connector 2. The second connector 3 is provided with a press-fit projection 44. The press-fitting of the press-fit projection 44 of the second connector 3 into the press-fit groove 13 of the first connector 2 allows preventing the entry of water from the surface to which the sheet-shaped waterproof material 35 is bonded fast and preventing the entry of water through the surfaces of the press-fit projection 44 and the press-fit groove 13 (FIG. 4).

In the connector assembly described in JP-A-2016-157529, a first circuit is connected to the bottom surface of the first connector 2 (the receptacle), and a second circuit is connected to the bottom surface of the second connector 3 (the plug). The first connector 2 and the second connector 3 are connected to each other on a surface, to which the first circuit is not connected, of the first connector 2 and a surface, to which the second circuit is not connected, of the second connector 3 (the top surface of the first connector 2 and the top surface of the second connector 3). Consequently, the connector assembly provides electrical connections to the first and second circuits. If an electronic apparatus including the connector assembly is a wearable device such as wireless earphones, or a smartphone, it is required to, for example, downsize the connector assembly or improve water resistance. The connector assembly described in JP-A-2016-157529 provides a low profile connector assembly with a small pitch between contacts, which has the function of preventing the entry of water.

SUMMARY

A connector assembly of the present embodiment is configured to include a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, and each of the first and second connectors is an integrally-molded product including an insulating member and a conductive member forming the first or second terminal.

DETAILED DESCRIPTION

Figure 1A:
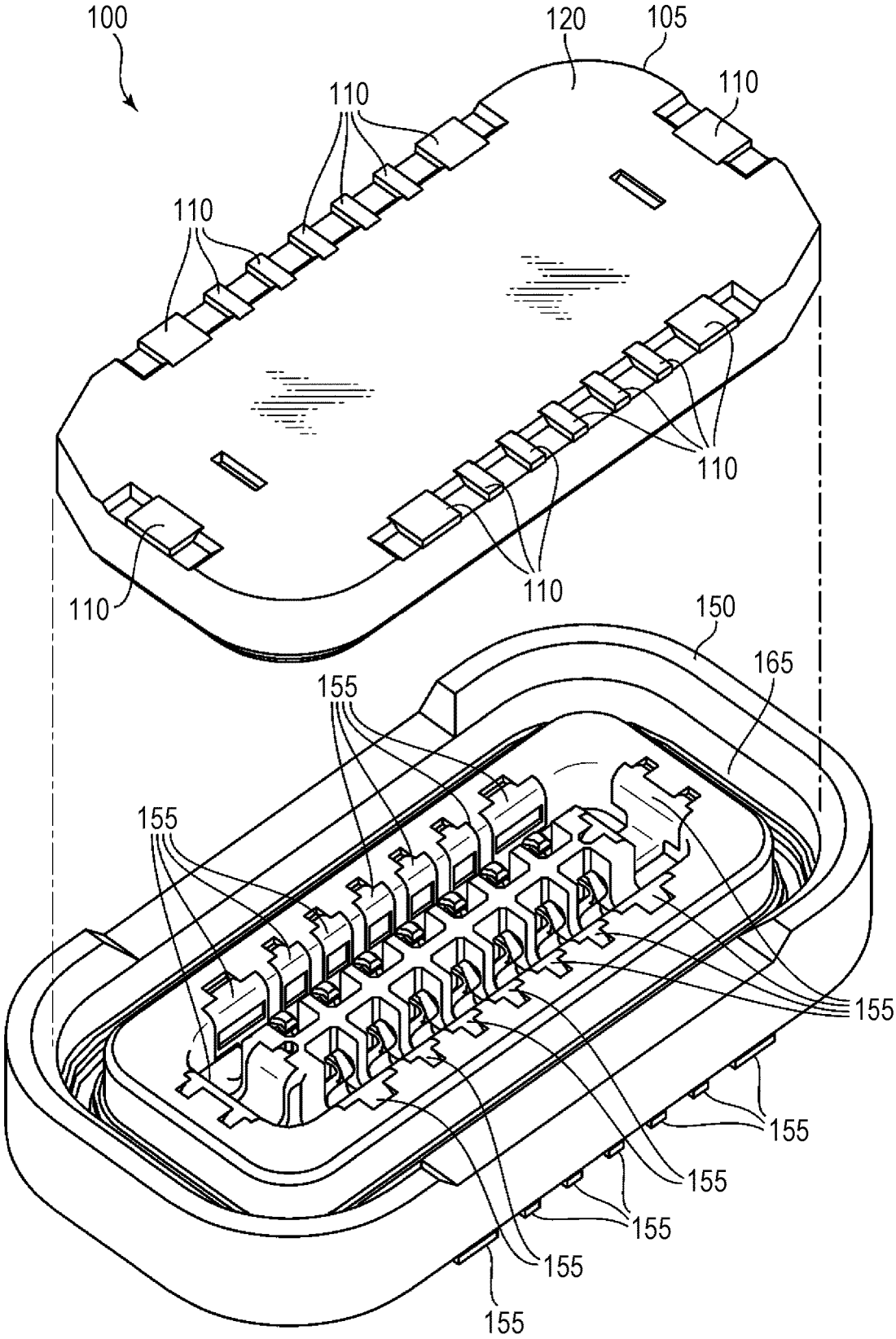
FIG. 1A is a perspective view of a connector assembly in a first embodiment, and is a diagram where a plug is placed on the upper side thereof and a receptacle on the lower side thereof.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, in terms of the connector assembly described in JP-A-2016-157529, the contacts are insert-molded in a housing of the first connector, and then the sheet-shaped waterproof material separated from the housing is further bonded fast to the first connector. Hence, the process of manufacturing the connector assembly is complicated.

One object of the present disclosure is to provide the following connector assembly and electronic apparatus including the connector assembly. The connector assembly and the electronic apparatus including the connector assembly can be easily manufactured, and can prevent the entry of a liquid substance.

A connector assembly of the present disclosure is a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, and each of the first and second connectors is an integrally-molded product including an insulating member and a conductive member forming the first or second terminal.

In the connector assembly of the present disclosure, each of the first and second connectors does not include a hole and a gap, which run from the bottom surface to the inside of the connector assembly.

In the connector assembly of the present disclosure, the projection portion of the first connector includes a press-fit portion, and the groove portion of the second connector includes a press-fit groove configured to receive the press-fit portion, or the groove portion of the second connector includes a press-fit portion, and the projection portion of the second connector includes a press-fit groove configured to receive the press-fit portion.

A connector assembly of the present disclosure includes a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, and at least one of the first and second connectors includes a reinforcing member.

In the connector assembly of the present disclosure, at least the first or second connector including the reinforcing member is an integrally-molded product including the reinforcing member, an insulating member, and a conductive member forming the first or second terminal.

A connector assembly of the present disclosure includes a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, and at least one of the projection portion and the groove portion includes a storage portion configured to store a liquid substance.

In the connector assembly of the present disclosure, each of the first and second connectors is an integrally-molded product including an insulating member and a conductive member forming the first or second terminal.

In the connector assembly of the present disclosure, at least one of the first and second connectors includes a reinforcing member.

In the connector assembly of the present disclosure, given two or more first terminals, the first terminals are placed, aligned, in a first direction on the bottom surface of the first connector, and given two or more second terminals, the second terminals are placed, aligned, in a first direction on the bottom surface of the second connector.

In the connector assembly of the present disclosure, given two or more first terminals, the first terminals are placed, aligned, in a first direction on the bottom surface of the first connector, or given two or more second terminals, the second terminals are placed, aligned, in a first direction on the bottom surface of the second connector.

In the connector assembly of the present disclosure, given three or more first terminals, the first terminals are placed, aligned in two rows, in a first direction on the bottom surface of the first connector, and given three or more second terminals, the second terminals are placed, aligned in two rows, in a first direction on the bottom surface of the second connector.

In the connector assembly of the present disclosure, given three or more first terminals, the first terminals are placed, aligned in two rows, in a first direction on the bottom surface of the first connector, or given three or more second terminals, the second terminals are placed, aligned in two rows, in a first direction on the bottom surface of the second connector.

In the connector assembly of the present disclosure, on the bottom surface of the first connector, at least one of the first terminals is oriented in a second direction and the other first terminals are oriented in a direction different from the second direction, and on the bottom surface of the second connector, at least one of the second terminals is oriented in a second direction and the other second terminals are oriented in a direction different from the second direction.

In the connector assembly of the present disclosure, wherein on the bottom surface of the first connector, at least one of the first terminals is oriented in a second direction orthogonal to the first direction and the other first terminals are oriented in a direction opposite to the second direction, and on the bottom surface of the second connector, at least one of the second terminals is oriented in a second direction orthogonal to the first direction and the other second terminals are oriented in a direction opposite to the second direction.

In the connector assembly of the present disclosure, on the bottom surface of the first connector, at least one of the first terminals is oriented in a second direction orthogonal to the first direction and the other first terminals are oriented in a direction opposite to the second direction, or on the bottom surface of the second connector, at least one of the second terminals is oriented in a second direction orthogonal to the first direction and the other second terminals are oriented in a direction opposite to the second direction.

An electronic apparatus of the present disclosure includes the connector assembly of the present disclosure.

First Embodiment

Figure 1B:
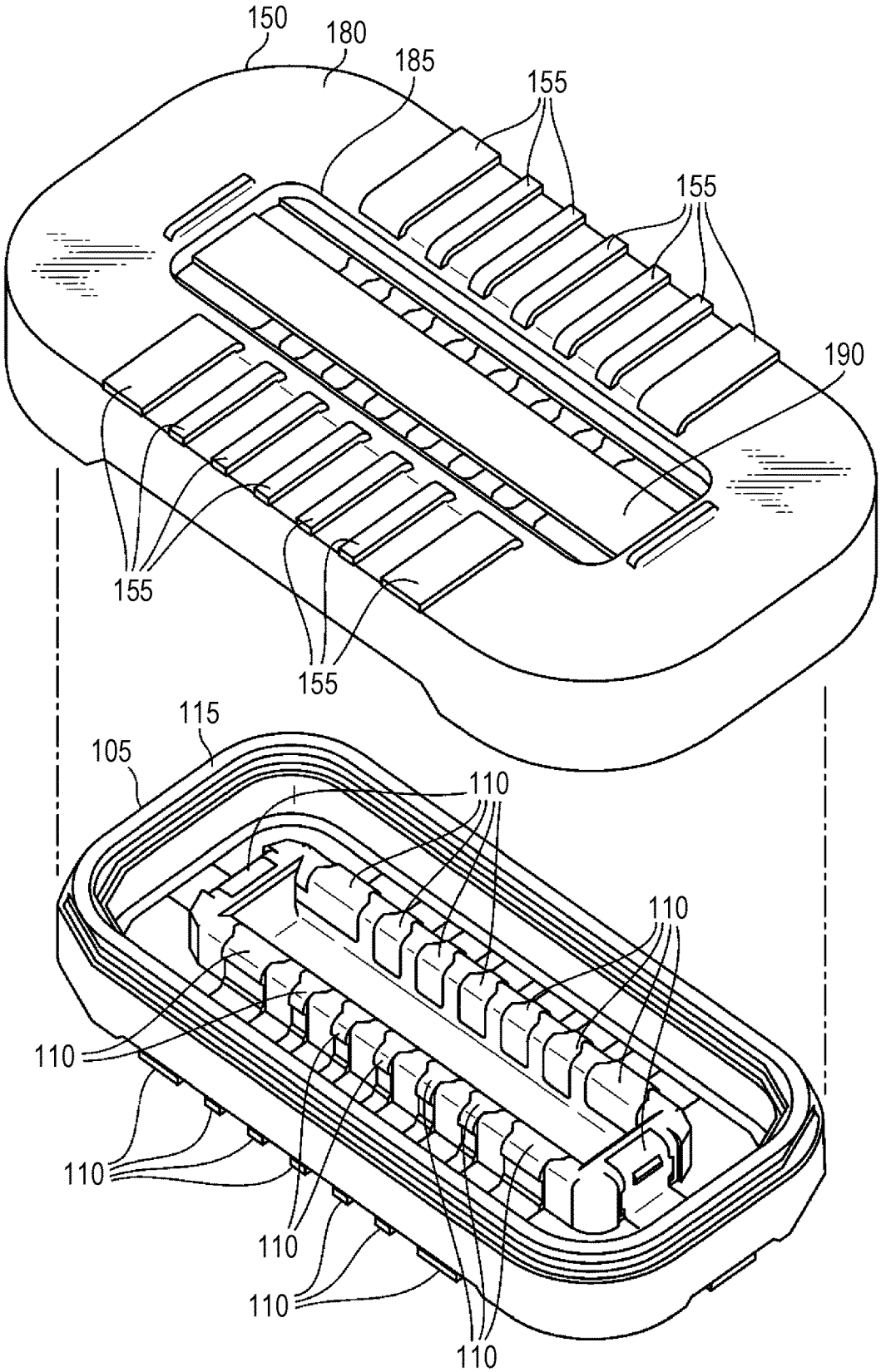
FIG. 1B is a perspective view of the connector assembly in the first embodiment, and is a diagram where the plug is placed on the lower side thereof and the receptacle on the upper side thereof.

FIGS. 1A and 1B illustrate perspective views of a connector assembly in a first embodiment. FIG. 1A is a diagram where a plug is placed on the upper side thereof and a receptacle on the lower side thereof. FIG. 1B is a diagram where the plug is placed on the lower side and the receptacle on the upper side. A connector assembly 100 includes a plug 105 and a receptacle 150. The plug 105 includes a projection portion 115 and one, or two or more plug terminals 110. The receptacle 150 includes a groove 165 and one, or two or more receptacle terminals 155. FIG. 1A illustrates a bottom surface 120 of the plug 105 and a top surface of the receptacle 150. FIG. 1B illustrates a bottom surface 180 of the receptacle 150 and a top surface of the plug 105. The plug terminal 110 provided to the bottom surface 120 of the plug 105 in FIG. 1A extends toward the top surface of the plug 105 through a main body of the plug 105 as illustrated in FIG. 1B. The receptacle terminal 155 provided to the bottom surface 180 of the receptacle 150 in FIG. 1B extends toward the top surface of the receptacle 150 through a main body of the receptacle 150 as illustrated in FIG. 1A.

In terms of the receptacle 150, the bottom surface 180, which is a surface opposite to the surface that receives the plug 105, that is, the surface on the side that mates with the plug 105, includes a depression 185. The depression 185 includes a protruding portion 190 inside the depression 185. The outer shape of the depression 185 may be a rectangular shape whose four corners are rounded, or a rectangle as illustrated in FIG. 1B.

Figure 2A:
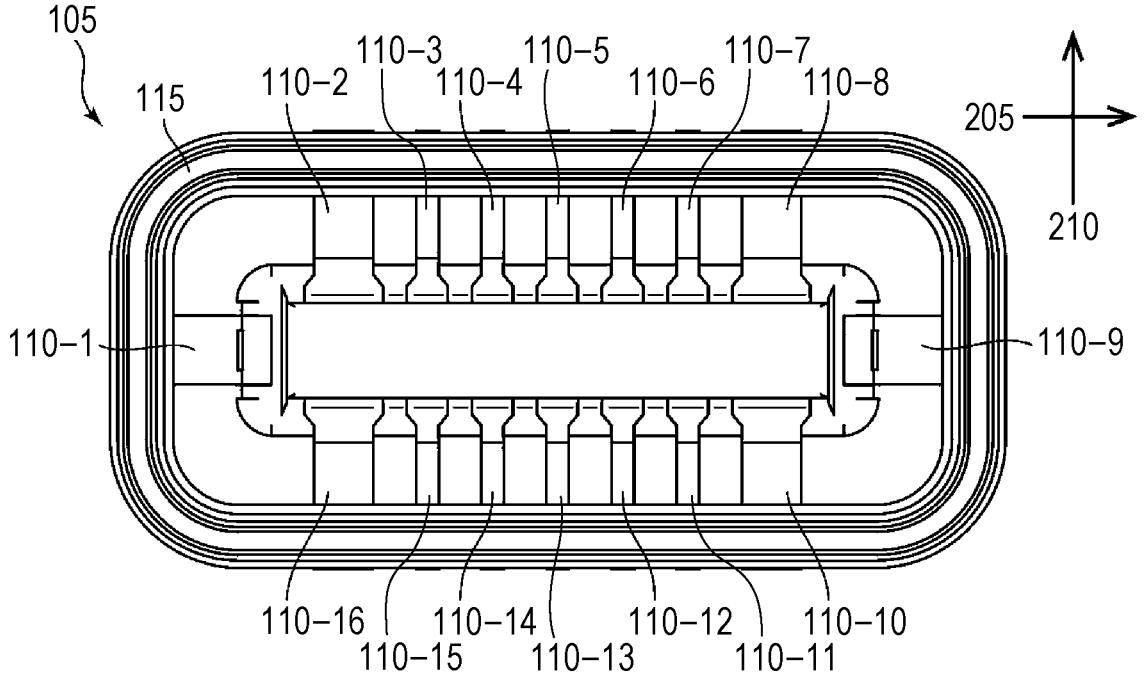
FIG. 2A is a plan view of the plug as viewed from above in the placement of the plug and the receptacle in FIG. 1B.
Figure 2B:
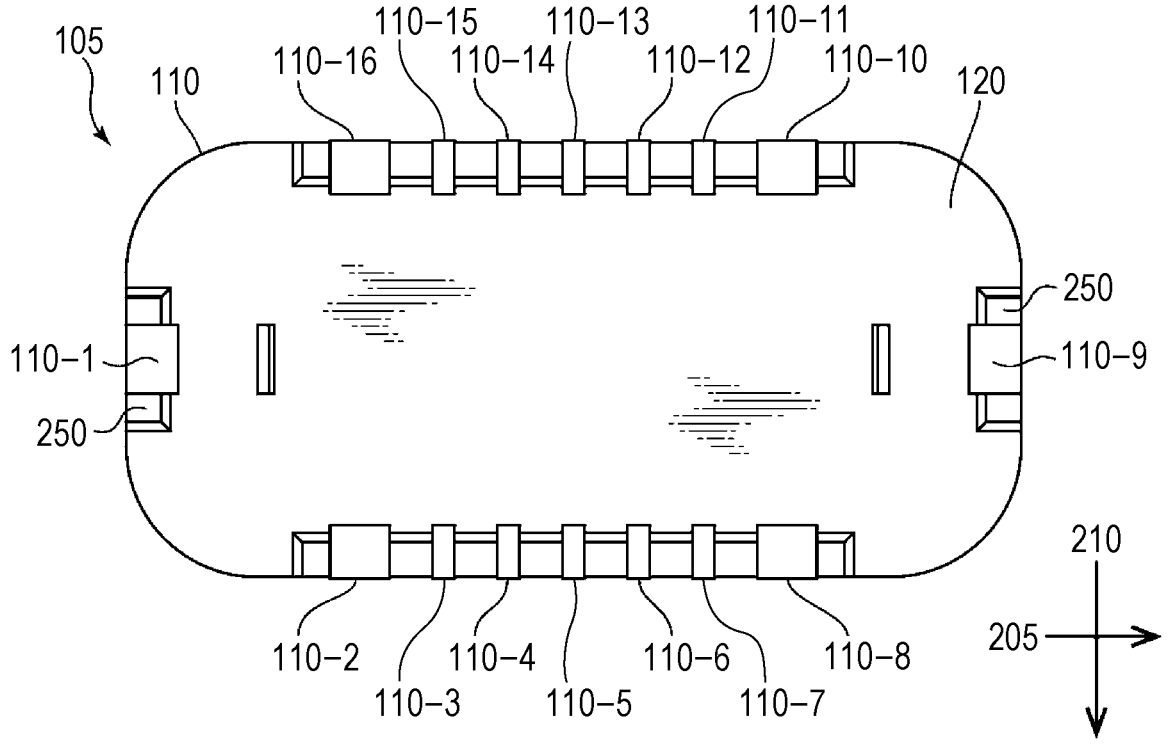
FIG. 2B is a plan view of the plug as viewed from above in the placement of the plug and the receptacle in FIG. 1A.

FIG. 2A illustrates a plan view of the plug 105 as viewed from above in the placement of the plug 105 in FIG. 1B. FIG. 2B illustrates a plan view of the plug 105 as viewed from above in the placement of the plug 105 in FIG. 1A. A plurality of plug terminals 110-*n* in FIGS. 2A and 2B corresponds to the plug terminals 110 in FIGS. 1A and 1B. Each of the plug terminals 110-*n* placed on the bottom surface 120 of the plug 105 illustrated in FIG. 2B corresponds to the plug terminal 110-*n* placed on the top surface of the plug 105 illustrated in FIG. 2A. The plug terminals 110-*n* are connected, on the bottom surface 120 of the plug 105, to, for example, another circuit board.

The plug terminals 110-2 to 110-8 are placed as the first row in a first direction 205 (a direction from the plug terminal 110-2 toward the plug terminal 110-8) on the bottom surface 120 of the plug 105. Similarly, the plug terminals 110-10 to 110-16 are placed as the second row in the first direction 205. In this manner, the plug terminals 110-2 to 110-8, which are placed as the first row on the bottom surface 120, extend in a second direction 210 (a direction from the plug terminal 110-16 toward the plug terminal 110-2) orthogonal to the first direction 205. The plug terminals 110-10 to 110-16 placed as the second row extend in a direction opposite to the second direction 210. As illustrated in FIG. 2A, the projection portion 115 continuously covers the perimeter of the plug 105.

Figure 3A:
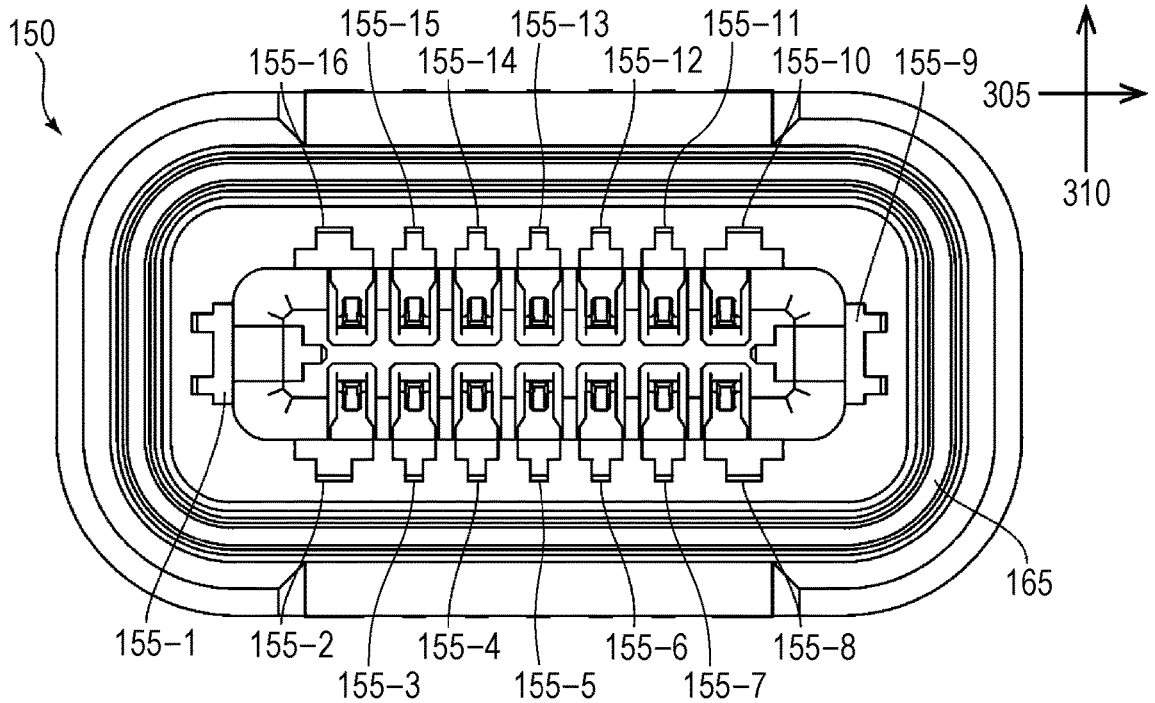
FIG. 3A is a plan view of the receptacle as viewed from above in the placement of the plug and the receptacle in FIG. 1A.
Figure 3B:
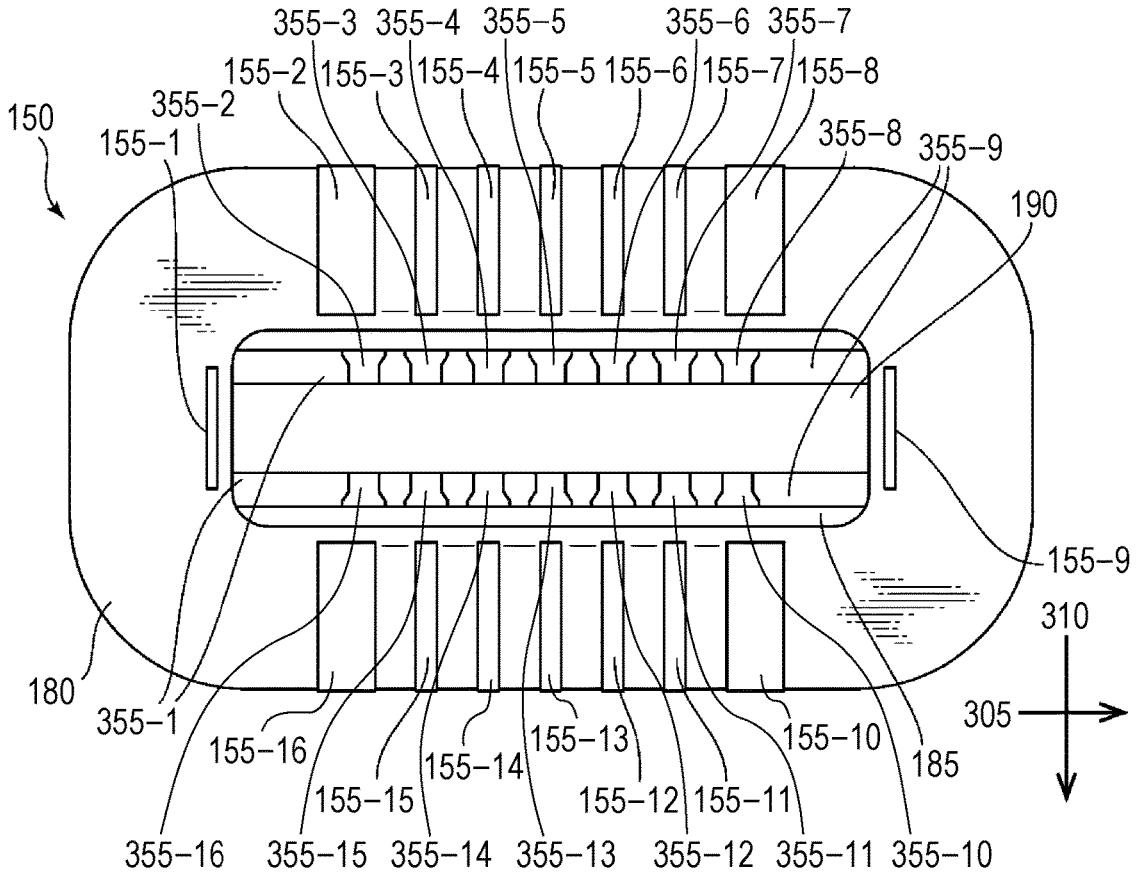
FIG. 3B is a plan view of the receptacle as viewed from above in the placement of the plug and the receptacle in FIG. 1B.

FIG. 3A illustrates a plan view of the receptacle 150 as viewed from above in the placement of the receptacle 150 in FIG. 1A. FIG. 3B illustrates a plan view of the receptacle 150 as viewed from above in the placement of the receptacle 150 in FIG. 1B. Receptacle terminals 155-*n* in FIGS. 3A and 3B correspond to the receptacle terminals 155 in FIGS. 1A and 1B. Each of the receptacle terminals 155-*n* placed on the top surface of the receptacle 150 illustrated in FIG. 3A corresponds to the receptacle terminal 155-*n* placed on the bottom surface 180 of the receptacle 150 illustrated in FIG. 3B. The bottom surface 180 of the receptacle 150 includes the depression 185. The receptacle terminal 155-*n* includes a portion 355-*n* where the receptacle terminal 155-*n* is exposed in the depression 185. The receptacle terminals 155-*n* are connected, on the bottom surface 180 of the receptacle 150 to, for example, another circuit board.

The receptacle terminals 155-2 to 155-8 are placed as the first row in a first direction 305 (a direction from the receptacle terminal 155-2 toward the receptacle terminal 155-8) on the bottom surface 180 of the receptacle 150. Similarly, the receptacle terminals 155-10 to 155-16 are placed as the second row in the first direction 305. In this manner, the receptacle terminals 155-2 to 155-8, which are placed as the first row on the bottom surface 180, extend in a second direction 310 (a direction from the receptacle terminal 155-16 toward the receptacle terminal 155-2) orthogonal to the first direction 305. The receptacle terminals 155-10 to 155-16 placed as the second row extend in a direction opposite to the second direction 310. As illustrated in FIG. 3A, the groove 165 continuously covers the perimeter of the receptacle 150.

Each of the plug and the receptacle according to the present disclosure is manufactured by integral molding (insert molding) by use of a conductive member forming a terminal and an insulating member (for example, resin) forming the main body (housing). In integral molding, the conductive member such as a terminal is placed in a mold, and then the resin liquefied at high temperature is poured into the mold to mold the plug and the receptacle. In other words, the plug and the receptacle are integrally-molded products including the conductive member such as the terminal and the insulating member such as resin. Therefore, in integral molding, portions where the mold and the terminal touch each other are exposed without covered by the resin forming the main body of the plug and the main body of the receptacle. In the embodiment, the portions that touch the mold are contact portions 415 and 455 contacting board circuits, which are described below, and the portion 355-*n*, which is exposed in the depression 185 in FIG. 3B, of the receptacle terminal 155-*n*.

If only the contact portions 415 and 455 contacting the board circuits are rendered the portions that touch the mold in another embodiment, the portion 355-*n*, which is exposed in the depression 185 in FIG. 3B, of the receptacle terminal 155-*n* may be covered by the resin for integral molding, that is, the resin forming the main body of the receptacle. In this case, the depression 185 of the receptacle 150 can be filled with the resin for integral molding. Portions other than the terminals on the bottom surface 180 of the receptacle 150 may be formed as one surface by filling the depression 185 with the resin for integral molding. Consequently, the thickness of the bottom surface portion of the receptacle 150 increases; accordingly, the strength of the receptacle 150 can be increased. Similarly, a depression 250 (FIG. 2B) on the bottom surface 120 of the plug 105 can also be filled with the resin for integral molding.

Figure 4A:
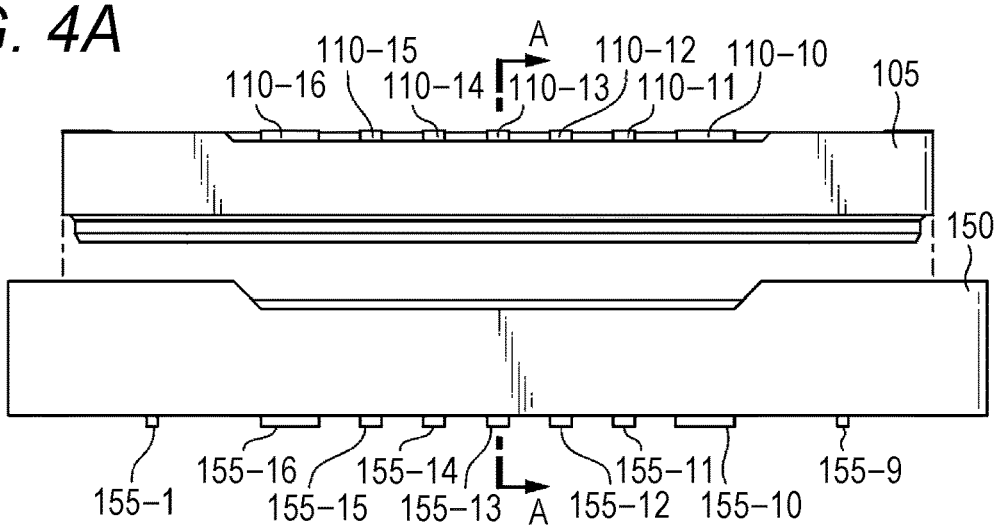
FIG. 4A is a side view of longitudinal portions of the plug and the receptacle before mating in the first embodiment.

FIG. 4A illustrates a side view of longitudinal portions of the plug 105 and the receptacle 150 before mating. FIG. 5A illustrates a side view of the longitudinal portions of the plug 105 and the receptacle 150 after mating. The plug terminals 110-10 to 110-16 correspond to and are connected to the receptacle terminals 155-10 to 155-16, respectively. The plug terminals 110-1 to 110-9, which are not illustrated in FIGS. 4A and 4B, correspond to and are connected to the receptacle terminals 155-1 to 155-9, respectively. Consequently, an electrical connection between the plug 105 and the receptacle 150 is provided.

Figure 4B:
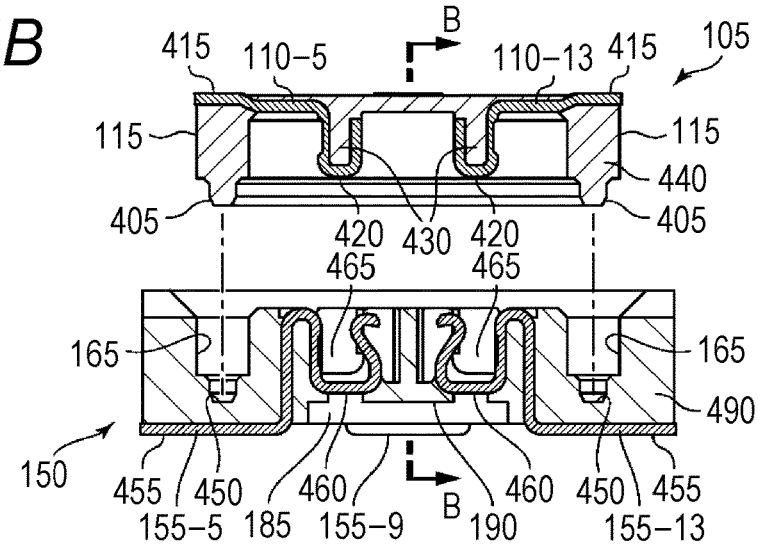
FIG. 4B is a cross-sectional view of the plug and the receptacle before mating in the first embodiment, and is a diagram of a cross-section along a line linking a pair of "As" in FIG. 4A as viewed in an arrow direction in FIG. 4A.
Figure 5A:
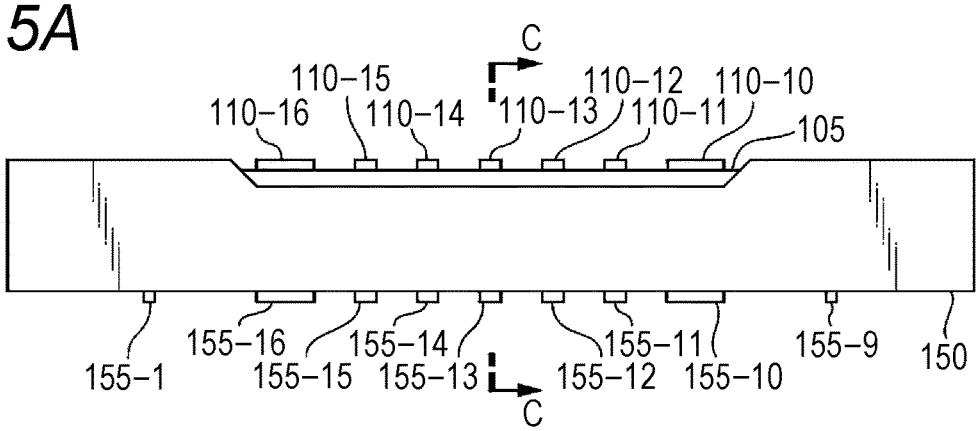
FIG. 5A is a side view of the longitudinal portions of the plug and the receptacle after mating in the first embodiment.
Figure 5B:
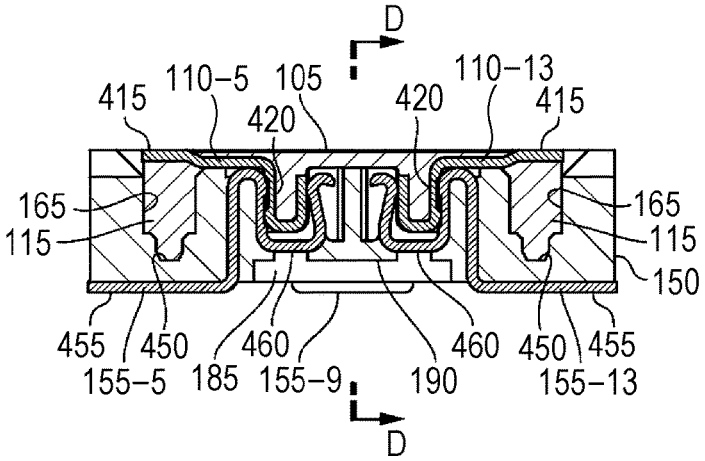
FIG. 5B is a cross-sectional view of the plug and the receptacle after mating in the first embodiment, and is a diagram of a cross-section along a line linking a pair of "Cs" in FIG. 5A as viewed in an arrow direction in FIG. 5A.

FIG. 4B illustrates a cross-sectional view of the plug 105 and the receptacle 150 before mating. FIG. 4B is a diagram of a cross-section along a line linking a pair of "As" in FIG. 4A as viewed in an arrow direction in FIG. 4A. FIG. 5B illustrates a cross-sectional view of the plug 105 and the receptacle 150 after mating. FIG. 5B is a diagram of a cross-section along a line linking a pair of "Cs" in FIG. 5A as viewed in an arrow direction in FIG. 5A.

Figure 4C:
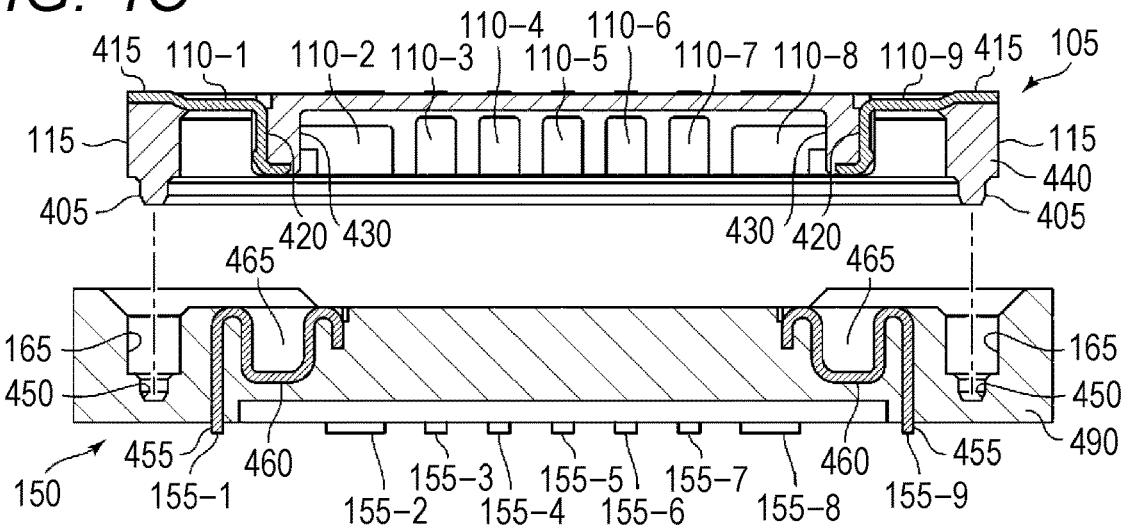
FIG. 4C is a cross-sectional view of the plug and the receptacle before mating in the first embodiment, and is a diagram of a cross-section along a line linking a pair of "Bs" in FIG. 4B as viewed in an arrow direction in FIG. 4B.
Figure 5C:
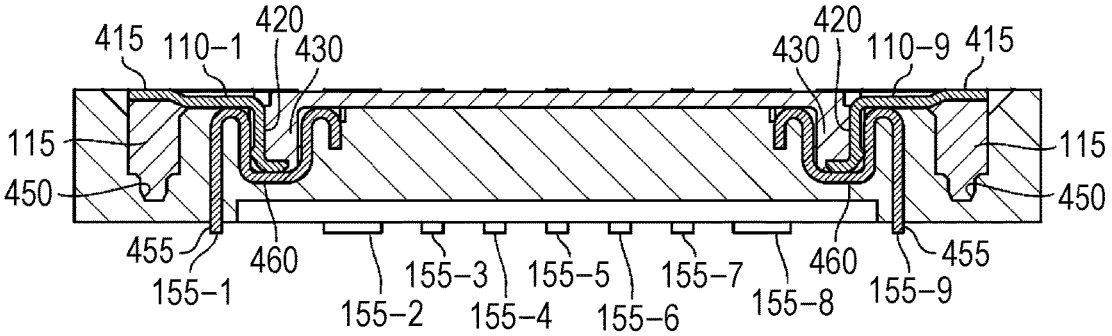
FIG. 5C is a cross-sectional view of the plug and the receptacle after mating in the first embodiment, and is a diagram of a cross-section along a line linking a pair of "Ds" in FIG. 5B as viewed in an arrow direction in FIG. 5B.

FIG. 4C illustrates a cross-sectional view of the plug 105 and the receptacle 150 before mating. FIG. 4C is a diagram of a cross-section along a line linking a pair of "Bs" in FIG. 4B as viewed in an arrow direction in FIG. 4B. FIG. 5C illustrates a cross-sectional view of the plug 105 and the receptacle 150 after mating. FIG. 5C is a diagram of a cross-section along a line linking a pair of "Ds" in FIG. 5B as viewed in an arrow direction in FIG. 5B.

The plug 105 and the receptacle 150 are formed, including the main body (housing) made out of the insulating member, for example, resin such as plastic or a liquid-crystal polymer, and the terminals made out of the conductive member, for example, copper. FIGS. 4B and 4C and FIGS. 5B and 5C illustrate a plug main body 440 and a receptacle main body 490, and the plug terminals 110 and the receptacle terminals 155. The main body and terminals of each of the plug 105 and the receptacle 150 are integrally formed by integral molding (insert molding) by use of the insulating member and the conductive member. Consequently, the main body and the terminal of the plug 105 are formed in intimate contact with each other, and the main body and the terminal of the receptacle 150 are formed in intimate contact with each other. Consequently, it is possible to prevent the generation of a hole and a gap, which reach the inside of the connector assembly from all the outer surfaces of the connector assembly including the bottom surfaces of the plug 105 and the receptacle 150, in the connector assembly formed by mating the plug 105 and the receptacle 150. Hence, it is possible to prevent the entry of liquid substances including a liquid such as water, resin liquefied at high temperature, and a slime substance into the inside of the connector assembly (the surfaces opposite to the bottom surfaces) from the outside. Moreover, each of the plug 105 and the receptacle 150 is manufactured as an integrally-molded product by integral molding; accordingly, the use of materials other than the materials of the main bodies and the terminals of the plug 105 and the receptacle 150 is not necessarily required. As a result, the connector assembly can be easily manufactured.

As illustrated in FIGS. 4B and 4C, the plug 105 includes the plug terminals 110. The plug terminal 110 includes the plug-side board circuit contact portion 415 and a receptacle contact portion 420. The main body 440, which is formed of the insulating member, of the plug 105 includes a plug terminal protruding portion 430 for forming the receptacle contact portion 420 that can be electrically connected to the receptacle 150. A part of or the entire wall of the plug terminal protruding portion 430 may contact an inner wall of the receptacle contact portion 420. The main body 440 of the plug 105 further includes the projection portion 115.

The receptacle 150 includes the receptacle terminals 155. The receptacle terminal 155 includes the receptacle-side board circuit contact portion 455 and a plug contact portion 460. The main body 490 of the receptacle 150 includes a receptacle terminal recessed portion 465 for forming the plug contact portion 460 that can be electrically connected to the plug 105. A part of or the entire wall of the receptacle terminal recessed portion 465 may contact an inner wall of the plug contact portion 460. The main body 490 of the receptacle 150 further includes the groove 165 corresponding to the projection portion 115 of the plug 105. As illustrated in FIGS. 5B and 5C, the plug 105 and the receptacle 150 are connected to each other; accordingly, the wall of the plug contact portion 460 in the receptacle 150 comes into contact with the wall of the receptacle contact portion 420 of the plug 105. Consequently, an electrical connection between the plug 105 and the receptacle 150 is provided.

As illustrated in FIGS. 5B and 5C, the groove 165 of the receptacle 150 receives the projection portion 115 of the plug 105. Consequently, the projection portion 115 is fitted into the groove 165. The projection portion 115 further includes a press-fit portion 405 at a distal end thereof on the fitting side. The groove 165 further includes a press-fit groove 450 on the bottom side. When the groove 165 of the receptacle 150 receives the projection portion 115 of the plug 105, a wall of the groove 165 comes into intimate contact with a wall of the projection portion 115 as illustrated in FIG. 5B. Furthermore, a wall of the press-fit groove 450 comes into intimate contact with a wall of the press-fit portion 405. Consequently, the projection portion 115 of the plug 105 fits in the groove 165 of the receptacle 150, which eliminates a gap between the groove 165 and the projection portion 115. Hence, it is possible to prevent the entry of the liquid substances into the receptacle 150 and the plug 105. Furthermore, the press-fit portion 405 is made slightly larger in size than a portion, which receives the press-fit portion 405, of the press-fit groove 450. Accordingly, it is possible to further tighten the fit. If the height of the groove 165 of the receptacle 150 is further increased, a distance between the outside of the connector assembly and the inside of the connector assembly along a surface on a side where the groove 165 of the receptacle 150 and the projection portion 115 of the plug 105 contact each other (a creepage distance along the surfaces of the groove 165 and the projection portion 115) is increased. Accordingly, the function of preventing the entry of the liquid substances into the connector is further improved. The height of the groove 165 is preferably, for example, equal to or greater than three-fifths the height of the receptacle 150. If the degree of intimate contact between the wall of the groove 165 and the wall of the projection portion 115 is not sufficient, a gap is created between the wall of the groove 165 and the wall of the projection portion 115. The gap serves as a passage for the entry of the liquid substances. Accordingly, the liquid substance may enter the inside of the connector assembly through the gap.

In the embodiment, the press-fit portion 405 of the plug 105 is continuously formed along the perimeter of the plug 105. Alternatively, the press-fit portion 405 may be formed on a part of the perimeter of the plug 105. The press-fit groove 165 is formed, corresponding to the press-fit portion 405.

In another embodiment, the groove 165 of the receptacle 150 may include a press-fit portion, and the projection portion 115 of the plug 105 may include a press-fit groove that receives the press-fit portion.

The connector assembly where the plug 105 and the receptacle 150 are connected to each other is connected to, for example, board circuits (not illustrated) of other electronic components via the plug terminals 110 and the receptacle terminals 155, which are provided to the bottom surfaces 120 and 180 of the plug 105 and the receptacle 150. After the plug 105 and the receptacle 150 are connected to, for example, the board circuits, respectively, and the plug 105 and the receptacle 150 are connected to each other, resin is applied to at least part of the surfaces of the board circuits, for example, for the purpose of fixing the connector assembly to the board circuits of the other electronic components, or preventing a short circuit caused by an unnecessary conductive member touching the connector assembly or board circuit. In such a case, the mating of the plug 105 and the receptacle 150 allows the connector assembly according to the embodiment to prevent the entry of the resin into the connector assembly. Consequently, it is possible to prevent the electrical connection between the plug contact portion 460 of the receptacle 150 and the receptacle contact portion 420 of the plug 105 from being insulated in the connector assembly due to the entry of the resin. Therefore, in terms of an electronic apparatus including the connector assembly according to the embodiment, a reduction in the incidence of defective products is achieved.

Figure 6A:
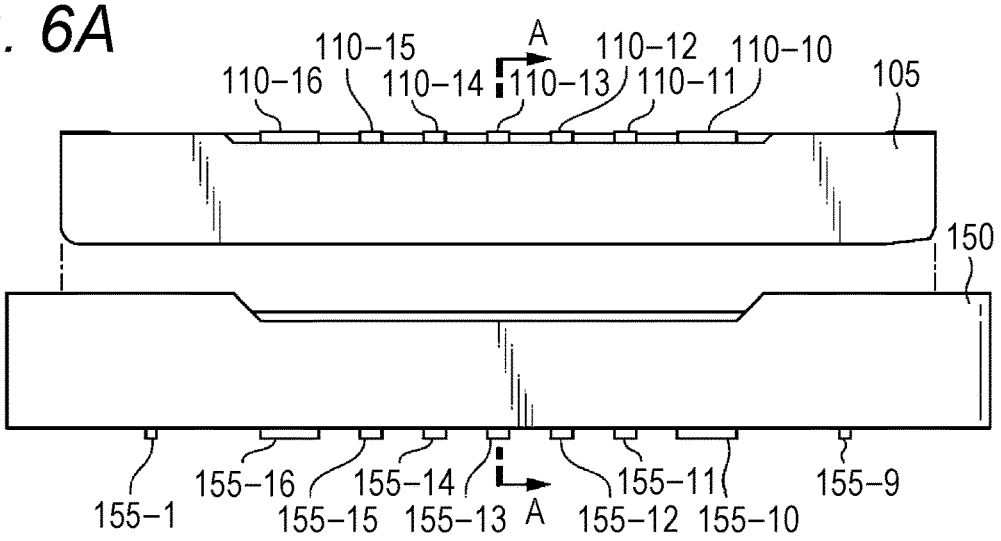
FIG. 6A is a side view of longitudinal portions of a plug and a receptacle in a second embodiment.
Figure 6B:
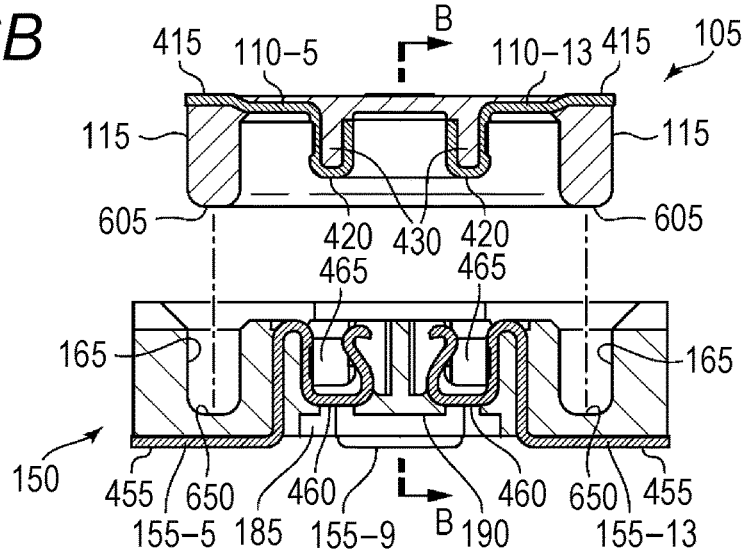
FIG. 6B is a cross-sectional view of the plug and the receptacle in the second embodiment, and is a diagram of a cross-section along a line linking a pair of "As" in FIG. 6A as viewed in an arrow direction in FIG. 6A.
Figure 6C:
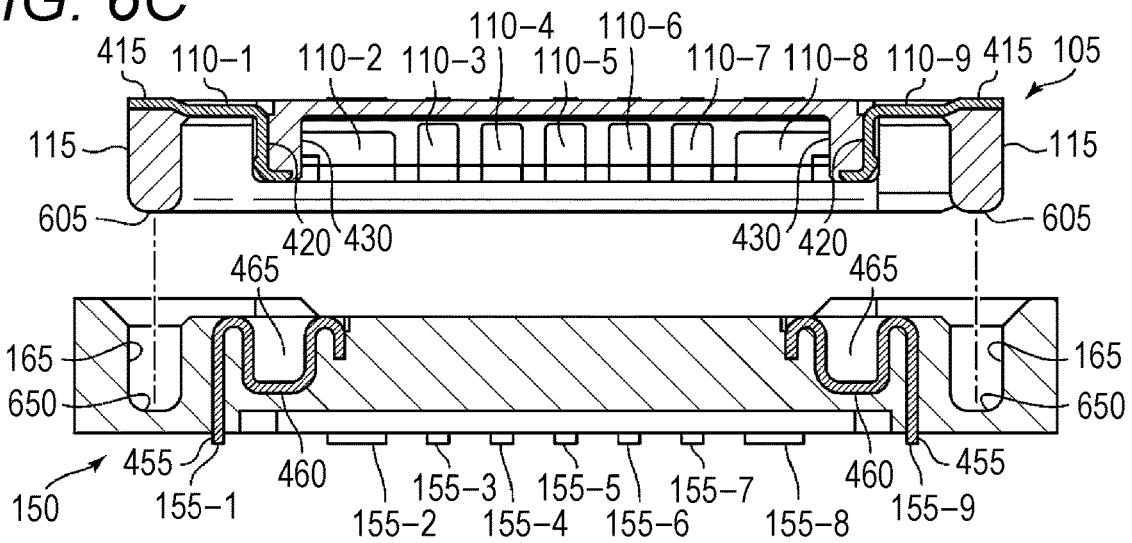
FIG. 6C is a cross-sectional view of the plug and the receptacle in the second embodiment, and is a diagram of a cross-section along a line linking a pair of "Bs" in FIG. 6B as viewed in an arrow direction in FIG. 6B.

Second Embodiment: A Connector Assembly where the Press-Fit Portion in the First Embodiment is Omitted FIG. 6A illustrates a side view of longitudinal portions of a plug 105 and a receptacle 150 in a second embodiment. FIG. 6B illustrates a cross-sectional view of the plug 105 and the receptacle 150 in the second embodiment. FIG. 6B is a diagram of a cross-section along a line linking a pair of "As" in FIG. 6A as viewed in an arrow direction in FIG. 6A. FIG. 6C illustrates a cross-sectional view of the plug 105 and the receptacle 150 in the second embodiment. FIG. 6C is a diagram of a cross-section along a line linking a pair of "Bs" in FIG. 6B as viewed in an arrow direction in FIG. 6B. Reference numerals in FIGS. 6A, 6B, and 6C correspond to those in FIGS. 4A, 4B, and 4C. The embodiment is different from the first embodiment in the respect that the press-fit portion 405 of the plug 105 and the press-fit groove 450 of the receptacle 150 in the first embodiment illustrated in FIGS. 4B and 4C are not provided. In other words, the embodiment is similar to the configuration of the first embodiment illustrated in FIGS. 4A, 4B, and 4C, except for the press-fit portion 405 and the press-fit groove 450.

In the embodiment, the projection portion 115 of the plug 105 does not include a press-fit portion. Moreover, the groove 165 of the receptacle 150 does not include a press-fit groove corresponding to the press-fit portion. The plug 105 and the receptacle 150 are connected to each other. Accordingly, the groove 165 can receive the projection portion 115. Furthermore, when the plug 105 and the receptacle 150 are connected to each other, a bottom surface 605 of the projection portion 115 may come into intimate contact with a bottom surface 650 of the groove 165. In this case, the length of the projection portion 115 in a height direction thereof is the same as, or greater than, the length of the groove 165 in a height direction thereof. The connector assembly in the embodiment does not include the press-fit portion and the press-fit groove. Accordingly, the fit is looser than the fit in the first embodiment. However, the projection portion 115 and the groove 165 in the embodiment can prevent the entry of liquid substances such as water and resin into the connector assembly.

Third Embodiment: A Connector Assembly Including Reinforcing Members

Figure 7A:
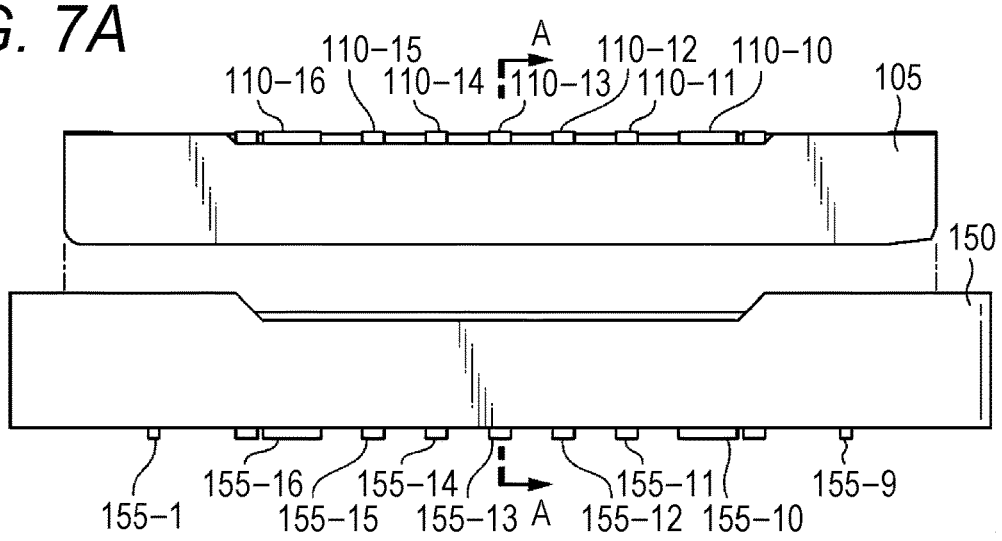
FIG. 7A is a side view of longitudinal portions of a plug and a receptacle in a third embodiment.
Figure 7B:
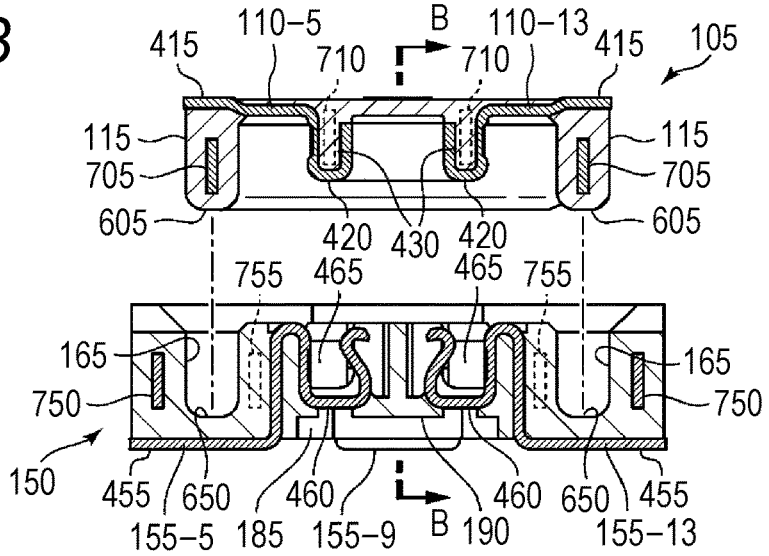
FIG. 7B is a cross-sectional view of the plug and the receptacle in the third embodiment, and is a diagram of a cross-section along a line linking a pair of "As" in FIG. 7A as viewed in an arrow direction in FIG. 7A.
Figure 7C:
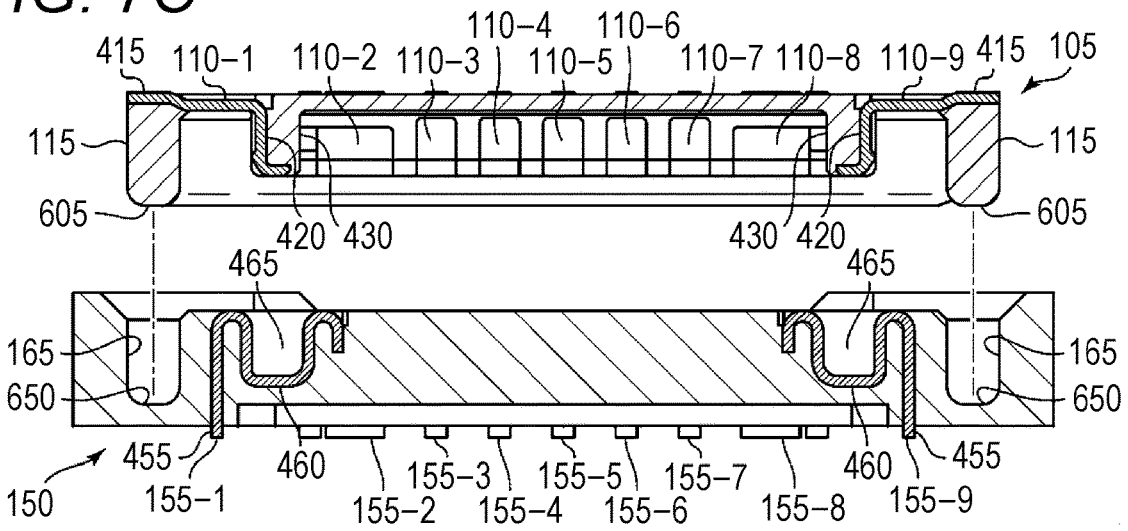
FIG. 7C is a cross-sectional view of the plug and the receptacle in the third embodiment, and is a diagram of a cross-section along a line linking a pair of "Bs" in FIG. 7B as viewed in an arrow direction in FIG. 7B.

FIG. 7A illustrates a side view of longitudinal portions of a plug 105 and a receptacle 150 in a third embodiment. FIG. 7B illustrates a cross-sectional view of the plug 105 and the receptacle 150 in the third embodiment. FIG. 7B is a diagram of a cross-section along a line linking a pair of "As" in FIG. 7A as viewed in an arrow direction in FIG. 7A. FIG. 7C illustrates a cross-sectional view of the plug 105 and the receptacle 150 in the third embodiment. FIG. 7C is a diagram of a cross-section along a line linking a pair of "Bs" in FIG. 7B as viewed in an arrow direction in FIG. 7B. Reference numerals in FIGS. 7A, 7B, and 7C correspond to those in FIGS. 6A, 6B, and 6C. The plug 105 and the receptacle 150 in the embodiment are different from the plug 105 and the receptacle 150 in the second embodiment illustrated in FIGS. 6A, 6B, and 6C in the respect that reinforcing members are provided. In other words, the embodiment is similar to the configuration of the second embodiment illustrated in FIGS. 6A, 6B, and 6C except for the reinforcing members.

In the embodiment, the plug 105 includes a reinforcing member 705, and the receptacle 150 includes a reinforcing member 750. The reinforcing member is placed in such a manner as to cover a part of or the entire perimeter of the longitudinal portion of the plug or receptacle. Consequently, the strength of the connector assembly is increased. The plug or receptacle without the reinforcing member is more susceptible to deformation than the plug or receptacle including the reinforcing member. Therefore, the receptacle or plug without the reinforcing member corresponding to the plug or receptacle including the reinforcing member deforms on the basis of the shape of the plug or receptacle including the reinforcing member. Consequently, the projection portion 115 of the plug 105 fits in the groove 165 of the receptacle 150 in more intimate contact with each other.

In another embodiment, the reinforcing member may be placed in such a manner as to cover a part of or the entire perimeter of another portion (for example, the perimeter of a lateral portion) of the plug or receptacle. In another embodiment, the reinforcing member may be placed not on the perimeter of the plug or receptacle, but in a place near a part of or the entire length in the longitudinal direction in a center portion of the plug or receptacle (for example, a reinforcing member 710 or 755 indicated by a dotted line in FIG. 7B). Moreover, the reinforcing members may be placed both on the perimeter of and in the center portion of the plug or receptacle. In another embodiment, the projection portion 115 of the plug 105 and the groove 165 of the receptacle 150 may include the press-fit portion 405 and the press-fit groove 450 respectively, which are illustrated in, for example, FIG. 4A.

Fourth Embodiment: A Connector Assembly Including a Storage Portion

Figure 8A:
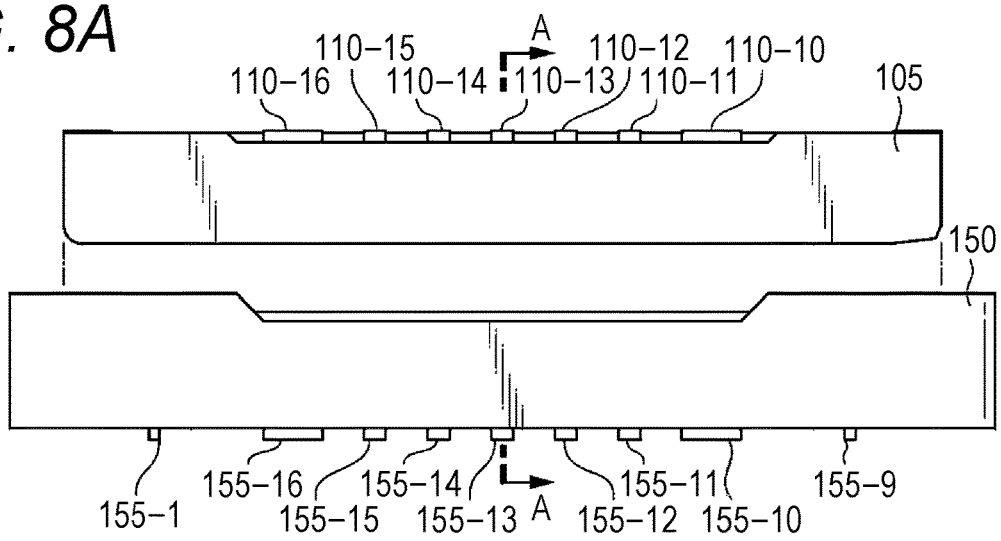
FIG. 8A is a side view of longitudinal portions of a plug and a receptacle in a fourth embodiment.
Figure 8B:
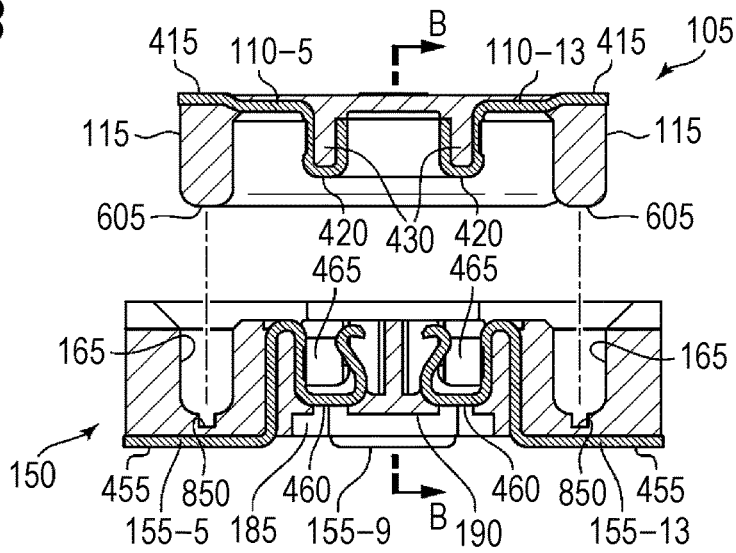
FIG. 8B is a cross-sectional view of the plug and the receptacle in the fourth embodiment, and is a diagram of a cross-section along a line linking a pair of "As" in FIG. 8A as viewed in an arrow direction in FIG. 8A.
Figure 8C:
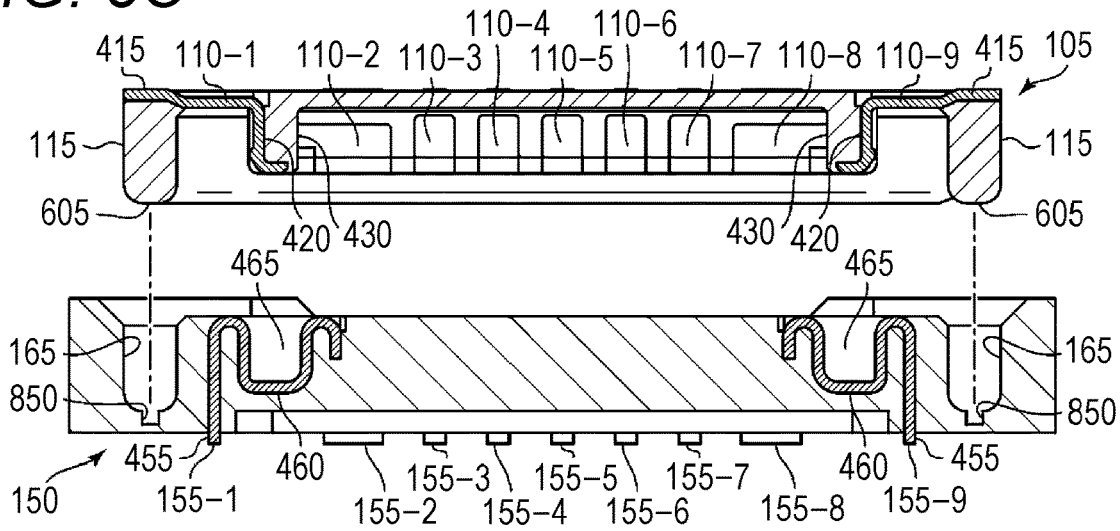
FIG. 8C is a cross-sectional view of the plug and the receptacle in the fourth embodiment, and is a diagram of a cross-section along a line linking a pair of "Bs" in FIG. 8B as viewed in an arrow direction in FIG. 8B.
Figure 9A:
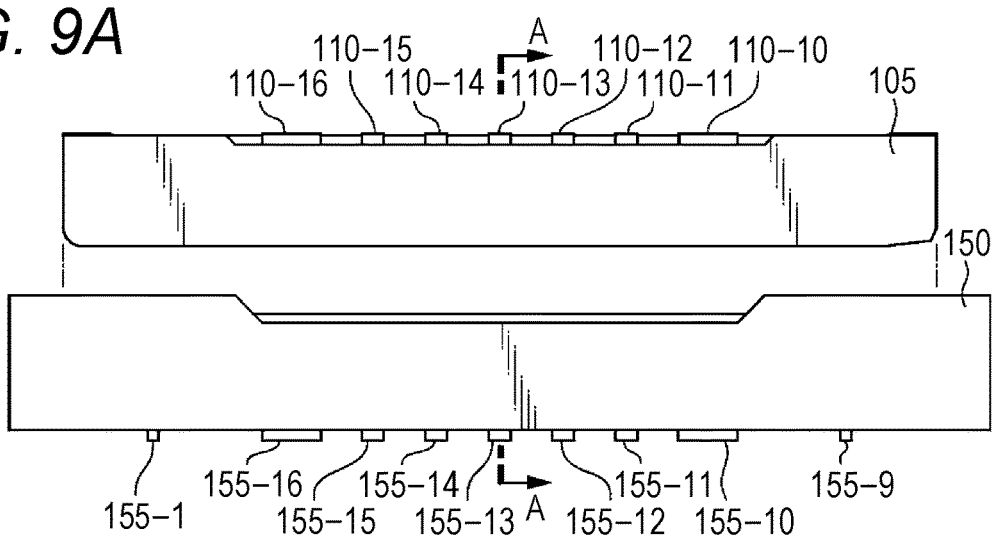
FIG. 9A is a side view of the longitudinal portions of the plug and the receptacle in the fourth embodiment.
Figure 9B:
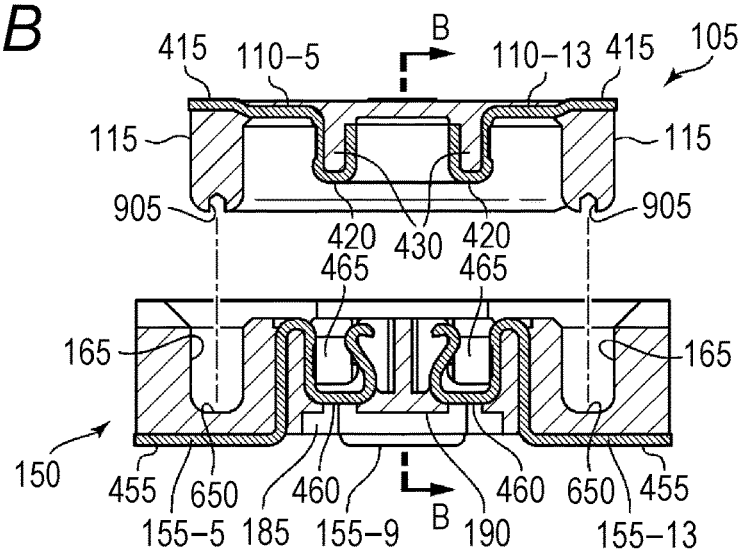
FIG. 9B is a cross-sectional view of the plug and the receptacle in the fourth embodiment, and is a diagram of a cross-section along a line linking a pair of "As" in FIG. 9A as viewed in an arrow direction in FIG. 9A.
Figure 9C:
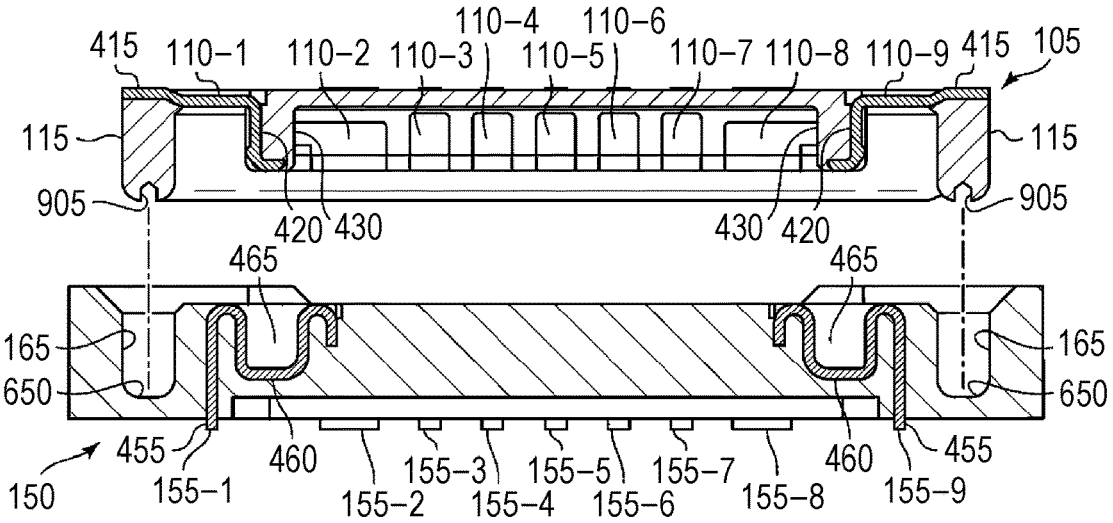
FIG. 9C is a cross-sectional view of the plug and the receptacle in the fourth embodiment, and is a diagram of a cross-section along a line linking a pair of "Bs" in FIG. 9B as viewed in an arrow direction in FIG. 9B.

FIG. 8A illustrates a side view of longitudinal portions of a plug 105 and a receptacle 150 in a fourth embodiment. FIG. 8B illustrates a cross-sectional view of the plug 105 and the receptacle 150 in the fourth embodiment. FIG. 8B is a diagram of a cross-section along a line linking a pair of "As" in FIG. 8A as viewed in an arrow direction in FIG. 8A. FIG. 8C illustrates a cross-sectional view of the plug 105 and the receptacle 150 in the fourth embodiment. FIG. 8C is a diagram of a cross-section along a line linking a pair of "Bs" in FIG. 8B as viewed in an arrow direction in FIG. 8B. FIG. 9A illustrates a side view of the longitudinal portions of the plug 105 and the receptacle 150 in the fourth embodiment. FIG. 9B illustrates a cross-sectional view of the plug 105 and the receptacle 150 in the fourth embodiment. FIG. 9B is a diagram of a cross-section along a line linking a pair of "As" in FIG. 9A as viewed in an arrow direction in FIG. 9A. FIG. 9C illustrates a cross-sectional view of the plug 105 and the receptacle 150 in the fourth embodiment. FIG. 9C is a diagram of a cross-section along a line linking a pair of "Bs" in FIG. 9B as viewed in an arrow direction in FIG. 9B. Reference numerals in FIGS. 8A, 8B, and 8C and FIGS. 9A, 9B, and 9C correspond to those in FIGS. 6A, 6B, and 6C. The plug 105 and the receptacle 150 in the embodiment are different from the plug 105 and the receptacle 150 in the second embodiment illustrated in FIGS. 6A, 6B, and 6C in the respect that a storage portion that stores liquid substances are provided. In other words, the embodiment is similar to the second embodiment illustrated in FIGS. 6A, 6B, and 6C except for the storage portion.

In the embodiment, at least one of the plug 105 and the receptacle 150 includes a storage portion (a reference numeral 850 in FIGS. 8B and 8C and a reference numeral 905 in FIGS. 9B and 9C). The storage portion can store liquid substances such as water and resin after the plug 105 and the receptacle 150 are mated together. Consequently, it is possible to prevent the entry of the liquid substances into a portion where the terminals of the plug 105 and the receptacle 150 are connected to each other (around the receptacle terminal recessed portion 465). If a liquid substance is a resin that is liquefied at high temperature and cures at low temperature, the resin cures after being stored in the storage portion in a liquid form. Consequently, it is possible to make the connection of the connector assembly firmer. Moreover, the liquid substance cures in the storage portion and a passage leading to the storage portion, which allows preventing the entry of a liquid substance such as water again after curing.

In the embodiment, the storage portion is provided on the bottom surface of the portion where the plug 105 and the receptacle 150 are mated together (the bottom surface of the projection portion 115 and the bottom surface of the groove 165 in FIGS. 8B and 8C and FIGS. 9B and 9C). However, this is an example. The storage portion may be provided in another place in the portion where the plug 105 and the receptacle 150 are mated together (the bottom surface of the projection portion 115 and an outer wall of the groove 165 in FIGS. 8B and 8C and FIGS. 9B and 9C). In the embodiment, the storage portion is placed in such a manner as to cover the entire perimeters of the plug 105 and the receptacle 150. However, the storage portion may be placed in such a manner as to cover part of the perimeters of the plug 105 and the receptacle 150.

In another embodiment, the storage portion may be provided to each of the projection portion 115 and the groove 165. For example, the storage portions of the projection portion 115 and the groove 165 may or may not touch each other. If the storage portions touch each other, the storage portions are provided to, for example, the bottom surfaces of the projection portion 115 and the groove 165. If the storage portions do not touch each other, the storage portion of the projection portion 115 may be provided to, for example, the bottom surface of the projection portion 115, and the storage portion of the groove 165 to, for example, the bottom surface of the groove 165. Furthermore, in another embodiment, the embodiment may include the reinforcing members illustrated in the third embodiment.

Figure 10A:
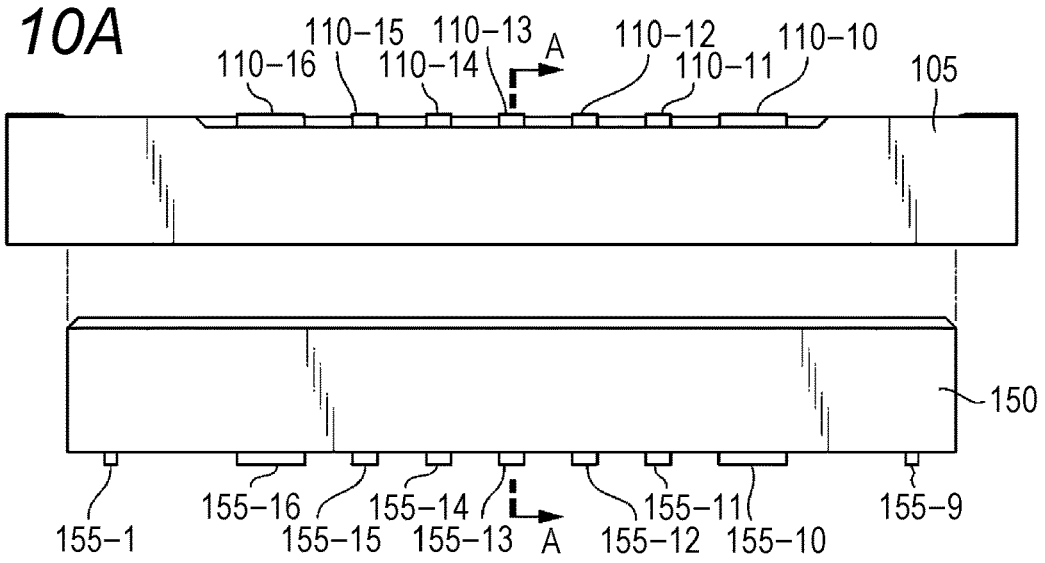
FIG. 10A is a side view of longitudinal portions of a plug and a receptacle in a fifth embodiment.
Figure 10B:
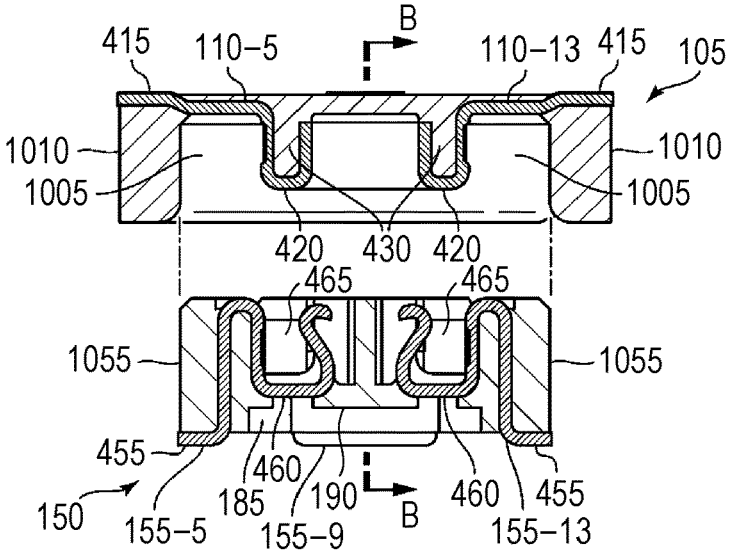
FIG. 10B is a cross-sectional view of the plug and the receptacle in the fifth embodiment, and is a diagram of a cross-section along a line linking a pair of "As" in FIG. 10A as viewed in an arrow direction in FIG. 10A.
Figure 10C:
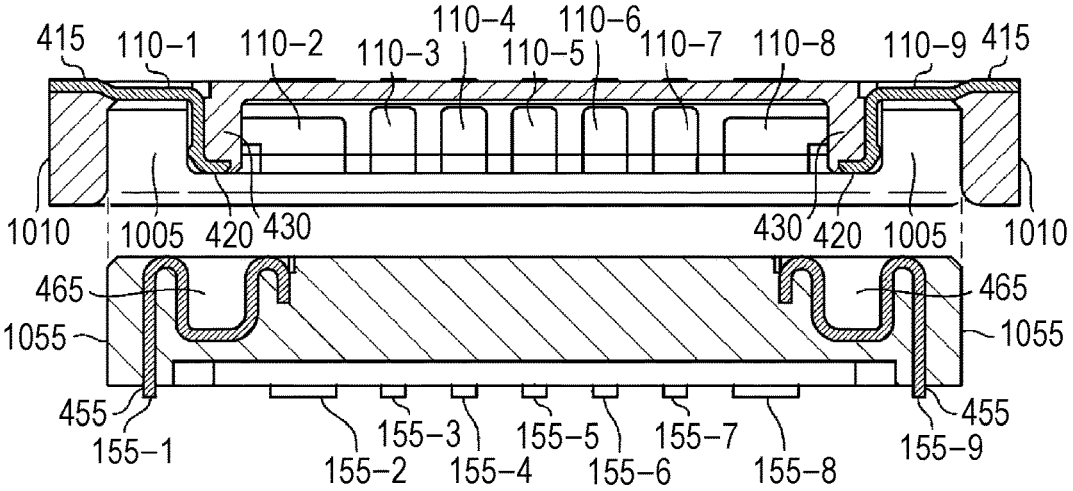
FIG. 10C is a cross-sectional view of the plug and the receptacle in the fifth embodiment, and is a diagram of a cross-section along a line linking a pair of "Bs" in FIG. 10B as viewed in an arrow direction in FIG. 10B.

Fifth Embodiment: A Connector Assembly where Side Walls of the Connector Assembly are Realized by the Outer Wall of the Plug FIG. 10A illustrates a side view of longitudinal portions of a plug 105 and a receptacle 150 in a fifth embodiment. FIG. 10B illustrates a cross-sectional view of the plug 105 and the receptacle 150 in the fifth embodiment. FIG. 10B is a diagram of a cross-section along a line linking a pair of "As" in FIG. 10A as viewed in an arrow direction in FIG. 10A. FIG. 10C illustrates a cross-sectional view of the plug 105 and the receptacle 150 in the fifth embodiment. FIG. 10C is a diagram of a cross-section along a line linking a pair of "Bs" in FIG. 10B as viewed in an arrow direction in FIG. 10B. Reference numerals in FIGS. 10A, 10B, and 10C correspond to those in FIGS. 4A, 4B, and 4C. The plug 105 and the receptacle 150 in the embodiment are different from the plug 105 and the receptacle 150 in the first embodiment illustrated in, for example, FIGS. 4A, 4B, and 4C in the respect that side walls of the connector assembly are realized by an outer wall of the plug.

In the embodiment, the receptacle 150 includes a projection portion 1055 on the outermost side of the receptacle 150. In the embodiment, the plug 105 includes a groove 1005 surrounded by an outer wall 1010 and the plug terminal protruding portion 430. The groove 1005 receives the projection portion 1055 of the receptacle 150 to allow the projection portion 1055 to be fitted therein. Consequently, at least parts of a surface of the groove 1005 and a surface of the projection portion 1055 come into contact with each other. Consequently, it is possible to prevent the entry of liquid substances into the connector assembly. In the embodiment, it is possible to reduce the size of the main body of the receptacle 150 as compared to the size of the main body of the receptacle 150 in the first to fourth embodiments. Accordingly, it is possible to downsize the connector assembly, which further contributes a reduction in the amount of material of the main body used to manufacture the connector assembly.

Other Embodiments

In the connector assembly according to the above embodiments, given pairs of one plug terminal 110 on the bottom surface of the plug 105 and one receptacle terminal 155 on the bottom surface of the receptacle 150 corresponding to the one plug terminal 110, a plurality of pairs is placed in two rows in the longitudinal direction as illustrated in FIGS. 2B and 3B. In other words, the connector assembly according to the above embodiments includes a terminal array including two rows. However, this is an exemplification. The terminal array may include one row, or three or more rows.

For example, assume that some of terminals in the terminal array placed in one row is terminals of a first group, or that all terminals in the terminal array including a predetermined number of rows, for example, two or more rows are the terminals of the first group. In this case, on the bottom surfaces of the plug 105 and the receptacle 150, the terminals of the first group may be placed, oriented in a predetermined direction, and terminals of the other group other than the terminals of the first group may be placed, oriented in a direction other than the predetermined direction.

A "first connector" described in the claims indicates a plug or receptacle that includes a projection portion. A "second connector" described in the claims indicates the plug or receptacle that includes a groove that receives the projection portion.

A "first terminal" described in the claims indicates a terminal that is connected to a terminal of a board circuit that is required to be connected to the connector assembly in the first connector. A "second terminal" described in the claims indicates a terminal that is connected to a terminal of a board circuit that is required to be connected to the connector assembly in the second connector.

A "first contact portion" of the "first connector" in the description of the claims is connected to a "second contact portion" of the "second connector". Consequently, an electrical connection is provided to the connector assembly.

In the above embodiments, the plug 105 and the receptacle 150 are formed by integral molding, using at least an insulating member and a conductive member that forms the terminal. However, as can be understood by those skilled in the art, the plug 105 and the receptacle 150 may be integrally molded, including another member other than the insulating member and the conductive member that forms the terminal.

The above embodiments illustrate the bottom surfaces of the plug 105 and the receptacle 150 in a substantially rectangular shape. However, this is an exemplification. Another shape such as a substantially square shape or a substantially triangular shape is also possible. The connector assembly is formed into a shape suitable for an electronic apparatus that uses the connector assembly.

The embodiments described above may be realized as one embodiment by combining parts or all of the embodiments.

The structures and arrangements of the elements of the embodiments, which are described above, are mere exemplifications. Those skilled in the art can make many modifications to the embodiments. Examples of the modifications include changes to the sizes, dimensions, structures, shapes, and ratios of various elements, parameter values, mounting arrangements, the use of material, colors, and orientations.

The embodiments described above are exemplifications for explanation of the present disclosure. The present disclosure is not limited to these embodiments. The present disclosure can be carried out in various modes as long as it does not depart from a gist thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector assembly comprising:

a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, each of the first and second connectors is an integrally-molded product including an insulating member and a conductive member forming the first or second terminal, the projection portion is continuously formed along an entire perimeter of the first connector and the projection portion surrounds the first contact portion, the groove portion is continuously formed along an entire perimeter of the second connector and the groove portion surrounds the second contact portion, and at the projection portion of the first connector, the first terminal is located under a top of the projection portion and at the groove portion of the second connector, the second terminal is located under a bottom of the groove portion so that the top of the projection portion is in direct contact with the bottom of the groove portion along the entire perimeter of the first and second connectors and the direct contact between the top of the projection portion and the bottom of the groove portion surrounds the first contact portion and the second contact portion.

2. The connector assembly according to claim 1, wherein each of the first and second connectors does not include a hole and a gap, which run from the bottom surface to the inside of the connector assembly.

3. The connector assembly according to claim 1, wherein the projection portion of the first connector includes a press-fit portion, and the groove portion of the second connector includes a press-fit groove configured to receive the press-fit portion, or the groove portion of the second connector includes a press-fit portion, and the projection portion of the second connector includes a press-fit groove configured to receive the press-fit portion.

4. The connector assembly according to claim 1, wherein the first connector includes two or more first terminals, and the first terminals are placed, aligned, in a first direction on the bottom surface of the first connector, and the second connector includes two or more second terminals, and the second terminals are placed, aligned, in a first direction on the bottom surface of the second connector.

5. The connector assembly according to claim 4, wherein on the bottom surface of the first connector, at least one of the first terminals is oriented in a second direction and the other first terminals are oriented in a direction different from the second direction, and on the bottom surface of the second connector, at least one of the second terminals is oriented in a second direction and the other second terminals are oriented in a direction different from the second direction.

6. The connector assembly according to claim 4, wherein on the bottom surface of the first connector, at least one of the first terminals is oriented in a second direction orthogonal to the first direction and the other first terminals are oriented in a direction opposite to the second direction, and on the bottom surface of the second connector, at least one of the second terminals is oriented in a second direction orthogonal to the first direction and the other second terminals are oriented in a direction opposite to the second direction.

7. The connector assembly according to claim 4, wherein on the bottom surface of the first connector, at least one of the first terminals is oriented in a second direction orthogonal to the first direction and the other first terminals are oriented in a direction opposite to the second direction, or on the bottom surface of the second connector, at least one of the second terminals is oriented in a second direction orthogonal to the first direction and the other second terminals are oriented in a direction opposite to the second direction.

8. The connector assembly according to claim 1, wherein the first connector includes two or more first terminals, and the first terminals are placed, aligned, in a first direction on the bottom surface of the first connector, or the second connector includes two or more second terminals, and the second terminals are placed, aligned, in a first direction on the bottom surface of the second connector.

9. The connector assembly according to claim 1, wherein the first connector includes three or more first terminals, and the first terminals are placed, aligned in two rows, in a first direction on the bottom surface of the first connector, and the second connector includes three or more second terminals, and the second terminals are placed, aligned in two rows, in a first direction on the bottom surface of the second connector.

10. The connector assembly according to claim 1, wherein the first connector includes three or more first terminals, and the first terminals are placed, aligned in two rows, in a first direction on the bottom surface of the first connector, or the second connector includes three or more second terminals, and the second terminals are placed, aligned in two rows, in a first direction on the bottom surface of the second connector.

11. An electronic apparatus including the connector assembly according to claim 1.

12. A connector assembly comprising:

a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, at least one of the first and second connectors includes a reinforcing member, the projection portion is continuously formed along an entire perimeter of the first connector and the projection portion surrounds the first contact portion, the groove portion is continuously formed along an entire perimeter of the second connector and the groove portion surrounds the second contact portion, and at the projection portion of the first connector, the first terminal is located under a top of the projection portion and at the groove portion of the second connector, the second terminal is located under a bottom of the groove portion so that the top of the projection portion is in direct contact with the bottom of the groove portion along the entire perimeter of the first and second connectors and the direct contact between the top of the projection portion and the bottom of the groove portion surrounds the first contact portion and the second contact portion.

13. The connector assembly according to claim 12, wherein at least the first or second connector including the reinforcing member is an integrally-molded product including the reinforcing member, an insulating member, and a conductive member forming the first or second terminal.

14. A connector assembly comprising:

a first connector including a first terminal on a bottom surface thereof, and a first contact portion being a part of the first terminal and a projection portion on a surface opposite to the bottom surface; and a second connector including a second terminal on a bottom surface thereof, and a second contact portion being a part of the second terminal, the second contact portion being configured to be electrically connected to the first contact portion, and a groove portion configured to receive the projection portion, on a surface opposite to the bottom surface, wherein at least a part of a surface of the projection portion is in intimate contact with a part of a surface of the groove portion, at least one of the projection portion and the groove portion includes a storage portion configured to store a liquid substance, the projection portion is continuously formed along an entire perimeter of the first connector and the projection portion surrounds the first contact portion, the groove portion is continuously formed along an entire perimeter of the second connector and the groove portion surrounds the second contact portion, and at the projection portion of the first connector, the first terminal is located under a top of the projection portion and at the groove portion of the second connector, the second terminal is located under a bottom of the groove portion so that the top of the projection portion is in direct contact with the bottom of the groove portion along the entire perimeter of the first and second connectors and the direct contact between the top of the projection portion and the bottom of the groove portion surrounds the first contact portion and the second contact portion.

15. The connector assembly according to claim 14, wherein each of the first and second connectors is an integrally-molded product including an insulating member and a conductive member forming the first or second terminal.

16. The connector assembly according to claim 14, wherein at least one of the first and second connectors includes a reinforcing member.

* * * * *